US006617943B1

(12) United States Patent
Fazelpour

(10) Patent No.: US 6,617,943 B1
(45) Date of Patent: Sep. 9, 2003

(54) PACKAGE SUBSTRATE INTERCONNECT LAYOUT FOR PROVIDING BANDPASS/LOWPASS FILTERING

(75) Inventor: Siamak Fazelpour, San Diego, CA (US)

(73) Assignee: Applied Micro Circuits Corporation, San Diego, CA (US)

( * ) Notice: Subject to any disclaimer, the term of this patent is extended or adjusted under 35 U.S.C. 154(b) by 0 days.

(21) Appl. No.: 09/919,273

(22) Filed: Jul. 27, 2001

(51) Int. Cl.[7] ..... H01P 1/20; H01P 3/08
(52) U.S. Cl. ..... 333/204; 333/246
(58) Field of Search ..... 333/202, 104, 333/33, 246, 247, 204

(56) References Cited

U.S. PATENT DOCUMENTS 4,626,805 A * 12/1986 Jones ..... 333/246
5,057,798 A * 10/1991 Moye et al. ..... 333/238
5,057,804 A * 10/1991 Sogo et al. ..... 333/202
5,173,671 A * 12/1992 Wendler et al. ..... 333/167
5,229,727 A * 7/1993 Clark et al. ..... 333/238
5,408,053 A * 4/1995 Young ..... 333/238
5,424,693 A * 6/1995 Lin ..... 333/246
5,428,327 A * 6/1995 Bahl ..... 333/246
5,644,277 A * 7/1997 Gulick et al. ..... 333/246
5,689,216 A * 11/1997 Sturdivant ..... 333/260
5,821,836 A * 10/1998 Katehi et al. ..... 333/202
5,886,597 A * 3/1999 Riad ..... 333/247
5,994,983 A * 11/1999 Andersson ..... 333/246
6,023,211 A * 2/2000 Somei ..... 333/246
6,091,312 A * 7/2000 Sheen ..... 333/134
6,091,355 A * 7/2000 Cadotte et al. ..... 342/104
6,208,225 B1 3/2001 Miller

* cited by examiner

*Primary Examiner*—Seungsook Ham
(74) *Attorney, Agent, or Firm*—Incaplaw; Terrance A. Meador

(57) ABSTRACT

An electronic device package includes a multilayer substrate having an interconnect structure configured to propagate a high frequency signal from one metal layer to another metal layer. The configuration and layout of the interconnect structure, particularly the arrangement of the reference vias associated with the signal via, is selected such that a desired filter response is achieved. The filter response is realized without any additional capacitor or inductor components. Thus, the natural discontinuity created by the vias and the inherent parasitic capacitance and inductance associated with the vias can be utilized to create a desired lowpass or bandpass filter response.

28 Claims, 5 Drawing Sheets

PACKAGE SUBSTRATE INTERCONNECT LAYOUT FOR PROVIDING BANDPASS/LOWPASS FILTERING

FIELD OF THE INVENTION

The present invention relates generally to electronic circuit packaging techniques. More particularly, the present invention relates to electronic circuit package designs that utilize substrate interconnect vias.

BACKGROUND OF THE INVENTION

Many practical electronic circuit packaging applications, such as those used for optical communication components and wireless communication components, mandate very low signal insertion loss and very low signal return loss characteristics for specific operating frequencies. For example, a number of practical circuit designs (e.g., high speed clock circuits, high speed multiplexer circuits, and the like) may require low signal insertion loss and low signal return loss for a defined operating frequency band or for frequencies up to a specified limit. In this regard, bandpass and lowpass filter designs can be implemented in connection with such circuit designs to ensure that signals at the undesirable frequencies are attenuated while signals at the desired frequencies are efficiently transmitted.

Conventional filtering techniques often utilize special circuit components, e.g., discrete capacitors and inductors, to realize a bandpass filter or a lowpass filter associated with the desired signal. These discrete filtering components require additional space on the substrate, thus resulting in an increased package size, which may not be desirable in many applications. In addition, the use of discrete filtering components increases the complexity and manufacturing cost of the electronic circuit package.

BRIEF SUMMARY OF THE INVENTION

Electronic circuit substrate interconnect arrangements typically employ interconnect vias that establish a conducting pathway between two or more metal layers. The combination of a signal via and at least one reference via allows wave propagation from one layer to another. In lieu of discrete electronic components configured to provide a bandpass or lowpass filter, a multilayer electronic package according to the present invention utilizes the geometry of the signal and reference vias, the number of reference vias, and/or the layout of the conductive signal and reference traces surrounding the signal via to realize the bandpass or lowpass filter.

The above and other aspects of the present invention may be carried out in one form by an electronic interconnect structure that includes a signal via formed within a multilayer substrate having a first metal layer and a second metal layer, and a reference via formed within the multilayer substrate. The signal via and the reference via are configured to propagate a signal from the first metal layer to the second metal layer, and to provide a filter response for the signal.

BRIEF DESCRIPTION OF THE DRAWINGS

A more complete understanding of the present invention may be derived by referring to the detailed description and claims when considered in conjunction with the following Figures, wherein like reference numbers refer to similar elements throughout the Figures.

DETAILED DESCRIPTION OF A PREFERRED EMBODIMENT

It should be appreciated that the particular implementations shown and described herein are illustrative of the invention and its best mode and are not intended to otherwise limit the scope of the invention in any way. Indeed, for the sake of brevity, conventional techniques related to electronic packaging, substrate manufacturing, and interconnect technologies may not be described in detail herein. It should be noted that in addition to the example layouts shown and described herein, many alternative or additional functional layouts may be utilized by a practical embodiment.

Multilayer electronic packages often include an interconnect structure having a number of interconnect vias that establish conducting pathways between two or more metal layers. A multilayer package substrate can include any number of metal layers separated by insulation or dielectric layers; vias can be used to connect circuit components or conductive elements formed or located on one metal layer to circuit components or conductive elements formed or located on a second metal layer. In many practical high frequency applications, an interconnect via may introduce an unwelcome interconnect parasitic; its existence (and the associated high frequency signal propagation discontinuity) deteriorates the performance of the electronic package. Consequently, conventional design approaches strive to optimize the impedance matching from one metal layer, through the via, and to the other metal layer.

In contrast to conventional package designs that are intended to maintain a consistent impedance from one layer, through the interconnects, and to another layer, an electronic package according to the present invention utilizes the natural characteristics of a substrate interconnect structure as a building block for the implementation of a desired filter response, e.g., to realize a bandpass filter or a lowpass filter for a signal propagating through the interconnect structure. In this regard, the electronic package need not employ additional components or elements (such as capacitors and inductors) to filter the signal. Briefly, the configuration of the signal via and/or its associated reference vias impacts the manner in which the signal is propagated through the substrate. Consequently, a desired filter response can be obtained in response to a number of physical layout parameters such as: the number of reference vias corresponding to the signal via, the geometry of the signal and reference via arrangement, the shape/size of the vias, the configuration of the fanout region surrounding the signal via, the length of the vias, the pitch between the signal via and the reference vias, and the like. Any number of these parameters can be selected to achieve a particular filter characteristic for the interconnect structure.

Figure 1:
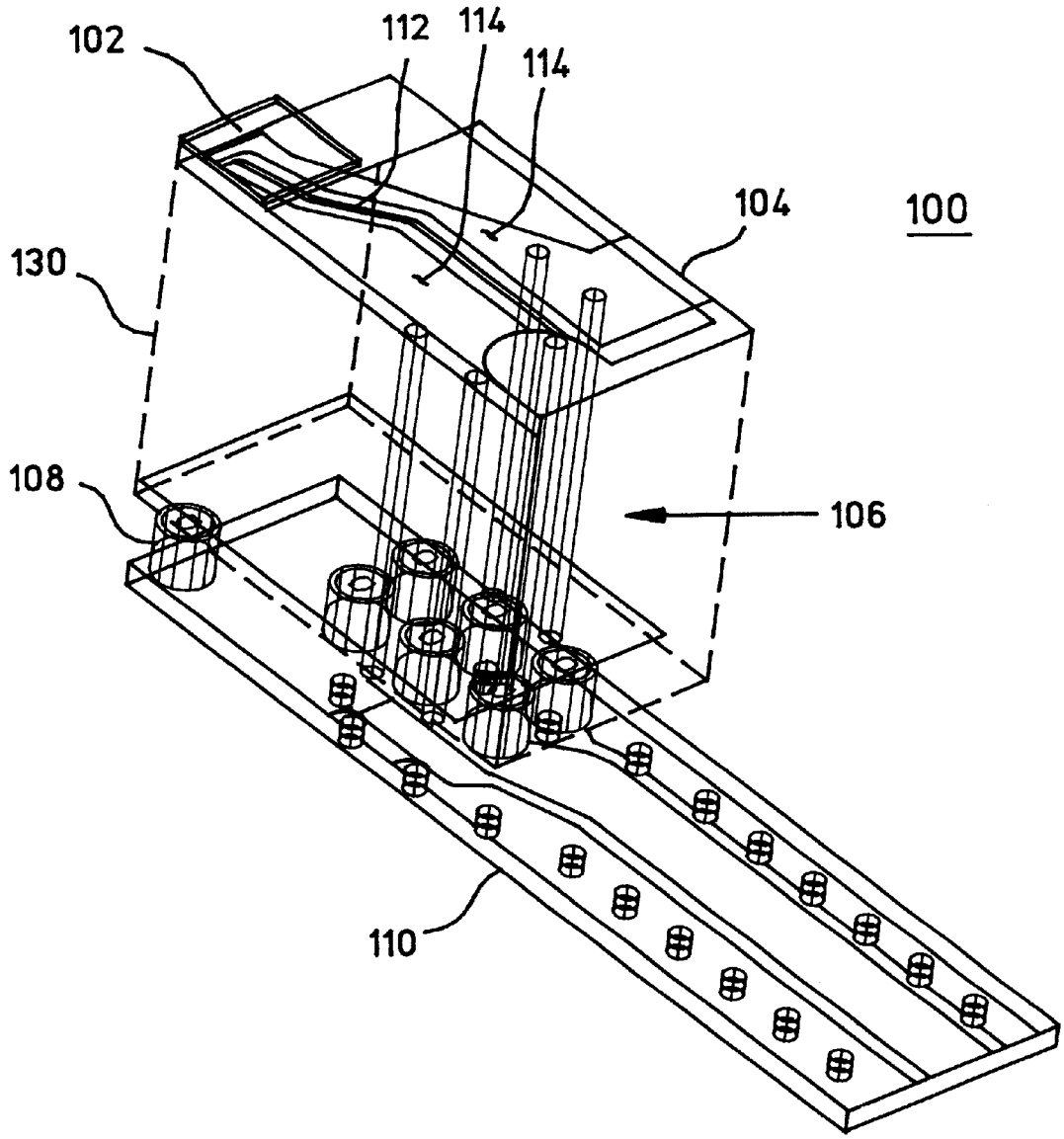
FIG. 1 is a perspective phantom view of an electronic package.

FIG. 1 is a perspective phantom view of an electronic package 100 that may incorporate the techniques of the present invention. Electronic package 100 is merely exemplary and the techniques of the present invention may be implemented in an unlimited number of practical package designs. Electronic package 100 generally includes adevice chip 102, a multilayer substrate 104 having a number of metal layers, an interconnect structure 106 formed within multilayer substrate 104, and a number of solderballs 108. In this example, electronic package 100 utilizes a ball grid array (BGA) substrate that can be connected to any suitable component such as a motherboard 110. In accordance with one practical example, multilayer substrate 104 utilizes BGA solderballs 108 having a diameter of 0.024 inches, with a solderball pitch of 1.0 millimeter.

Device chip 102 is depicted as a flip-chip package coupled to multilayer substrate 104. Device chip 102 and multilayer substrate 104 are suitably configured such that a high frequency output signal can be propagated from device chip 102 by way of a conductive signal element 112 and a number of conductive reference elements 114. Conductive reference elements 114 may represent a ground potential or any designated reference potential. In a practical embodiment, conductive signal element 112 and conductive reference elements 114 are suitably configured to achieve a particular transmission impedance, e.g., a 50 Ohm impedance. In this respect, the width of conductive signal element 112 and the gap spacing between conductive signal element 112 and conductive reference elements 114 can be selected to achieve the desired impedance.

Conductive signal element 112 and conductive reference elements 114 are shown in a coplanar waveguide (CPW) configuration. In a CPW configuration, conductive signal element 112 and conductive reference elements 114 are all formed on the same metal layer of multilayer substrate 104, e.g., the upper metal layer (often referred to as the "metal 1 layer"). Of course, the techniques of the present invention can also be extended for use with a microstrip mode or a mixed mode application, and the conductive signal and reference elements need not always be formed on the same metal layer.

Figure 2:
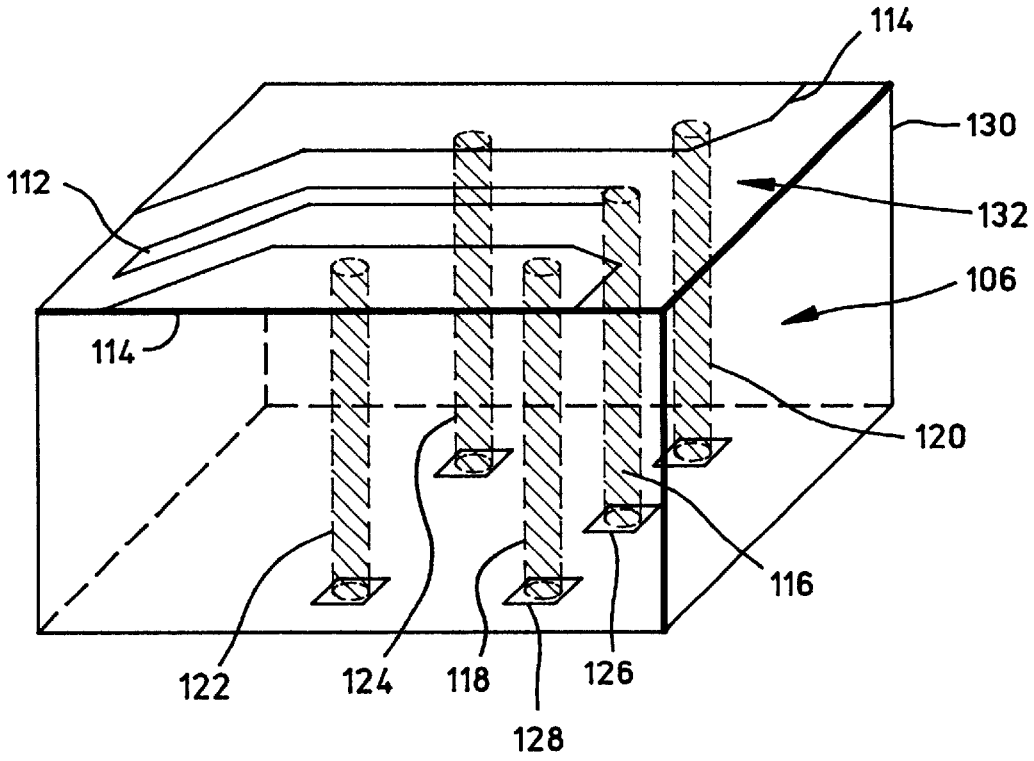
FIG. 2 is a perspective phantom view of an electronic package interconnect structure.

Referring to FIG. 2, interconnect structure 106 includes a signal via 116 formed within multilayer substrate 104 and connected at one end to conductive signal element 112, and at least one reference via 118, 120, 122, 124 formed within multilayer substrate 104 and connected at one end to a corresponding conductive reference element 114. The opposing end of signal via 116 terminates at (and is connected to) a suitably configured conductive element, e.g., a metal bond pad 126. The opposing end of each reference via 118, 120, 122, 124 also terminates at (and is connected to) a suitably configured conductive element, e.g., a metal bond pad 128. Although not a requirement of the present invention, metal bond pads 126, 128 are typically formed on the same metal layer of multilayer substrate 104, e.g., the lower metal layer (often referred to as the "last metal layer").

The output signal from device chip 102 propagates over the top of multilayer substrate 104 and propagates (by way of interconnect structure 106) through a dielectric layer 130 located between the upper metal layer and the lower metal layer. In this manner, electronic package 100 facilitates signal wave propagation from one metal layer to another metal layer using the signal and reference vias. Although not shown in FIGS. 1–2, multilayer substrate 104 may include any number of additional metal layers separated by dielectric material. The signal is eventually transferred to motherboard 110 through solderballs 108. In accordance with a practical embodiment, each metal bond pad 126, 128 contacts a respective solderball 108 and each solderball 108 contacts a respective conductive element located on motherboard 110.

Figure 3:
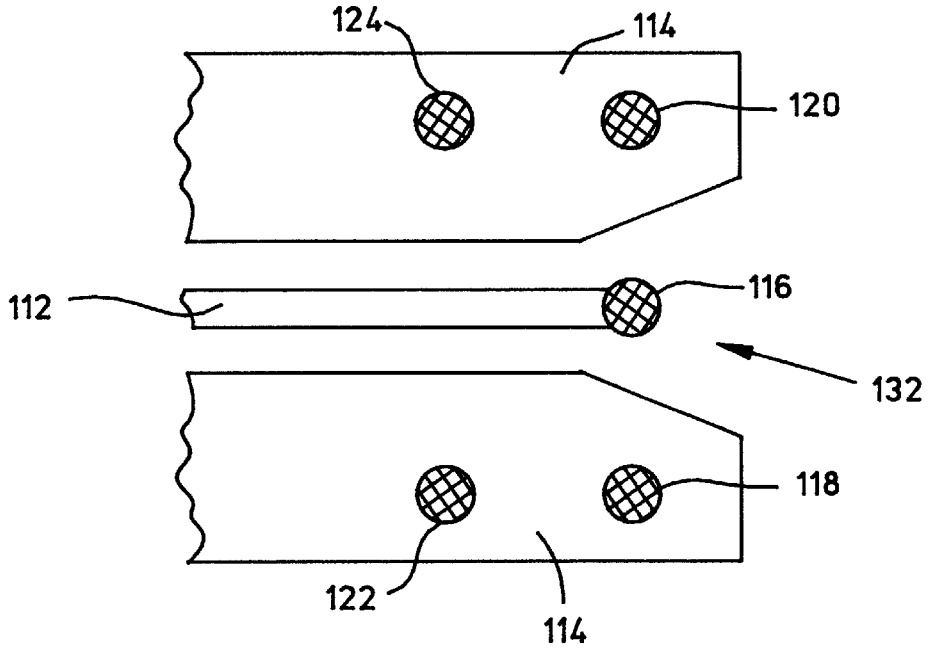
FIG. 3 is a top view of a portion of an interconnect layout.
Figure 4:
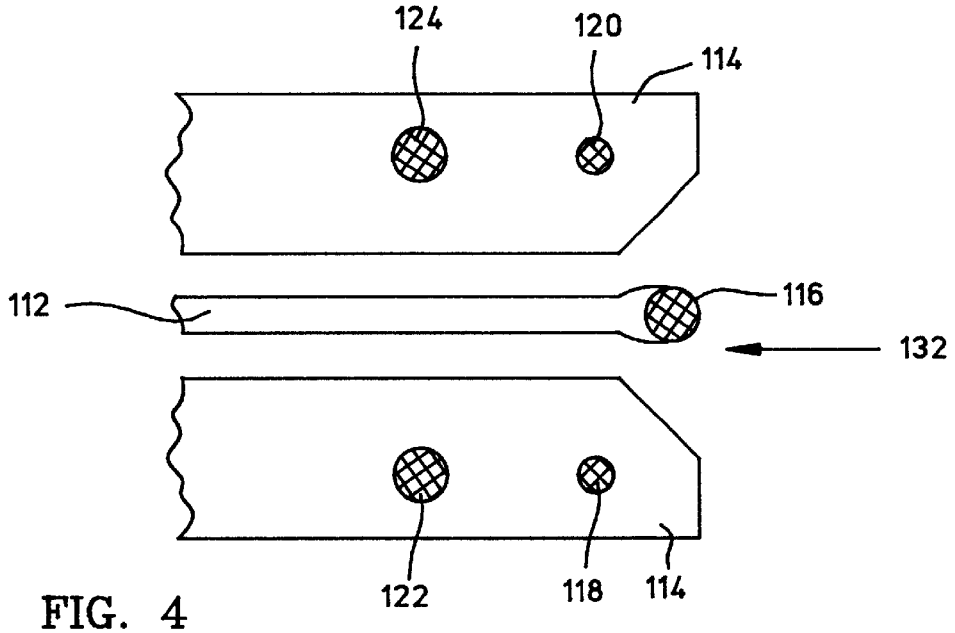
FIG. 4 is a top view of a portion of an alternate interconnect layout.

Referring to FIGS. 2–4, electronic package 100 may include a suitably configured fanout region 132 located proximate to signal via 116. Fanout region 132 can be defined by portions of conductive signal element 112 and by portions of conductive reference elements 114. In accordance with known principles, fanout region 132 is configured to facilitate the transition of the signal wave from the upper metal layer to the signal and reference vias (the horizontal to vertical transition represents a discontinuity that can impact the signal propagation). The specific configuration of fanout region 132 may be affected by the desired impedance matching, the operating frequencies, manufacturing limitations, and/or the desired filtering characteristics (as described in more detail below). For example, conductive reference elements 114 may be slightly tapered away from signal via 116 (as shown in FIG. 3) or significantly tapered away from signal via 116 (as shown in FIG. 4). Similarly, conductive signal element 112 may be tapered, notched, or otherwise shaped in a suitable manner proximate signal via 116 (as shown in FIG. 4). In addition, the location of signal via 116 between the tapered sections of conductive reference elements may vary from one package to another. For example, in FIG. 3, signal via 116 is positioned relatively deep within the tapered section, while in FIG. 4, signal via 116 is positioned near the outer edge of the tapered section. The example configurations shown in FIGS. 3–4 are not intended to limit the scope or application of the present invention, and electronic package 100 can employ any number of alternate fanout region configurations.

As described above, the configuration of interconnect structure 106 can achieve a particular filter characteristic for the signal, and additional components or conductive elements need not be employed. In practical embodiments, any number of the following parameters (individually or collectively) may impact the filter response attributed to interconnect structure 106: the pitch between the signal via and the reference via(s); the number of reference vias associated with the signal via; the geometry of the vias, e.g., the shape, size, diameter, cross sectional area, or length of the vias; the configuration of the fanout region; the spatial positioning of the reference via(s) relative to the signal via; and any other physical or geometrical characteristic of interconnect structure 106 or multilayer substrate 104 that affects the capacitance, inductance, or electronic propagation characteristics associated with the signal and reference vias.

The example embodiments shown in FIGS. 1–4 utilize four reference vias 118, 120, 122, 124 associated with signal via 116. However, the number of reference vias and their specific location and positioning relative to the corresponding signal via can vary according to the desired filter response. Such variation allows more or less capacitance to be added to interconnect structure 106. For example, the pitch (i.e., the center-to-center distance for cylindrical vias) between the signal via and the reference vias can be selected to achieve the desired bandpass or lowpass filter characteristic. In practice, the pitch of the reference vias that are closest to signal via 116 has the greatest impact on the filter response. Thus, the pitch of reference vias 118, 120 can be adjusted to affect the filter characteristics of interconnect structure 106. Of course, the pitch of reference vias 122, 124 can also be considered in the filter design, even though the corresponding effect may be less significant.

The effect of the pitch between signal via 116 and reference vias 122, 124 can be better understood in conjunction with the effect of fanout region 132. Usually, a fanout region represents an inductive element, due to the cutout in the reference "island" around the corresponding signal via. This cutout effectively increases the impedance of fanout region 132 (when compared to the standard transmission impedance of 50 Ohms). Reducing the pitch between signal via 116 and reference vias 122, 124 can lower the vertical transmission impedance to partially compensate for the inductive effect of fanout region 132. Consequently, the filter cutoff frequency is increased. The filter cutoff frequency can be decreased in a similar manner by increasing the pitch between signal via 116 and reference vias 122, 124.

The cross sectional area, the cross sectional shape, and the length of the vias can also be chosen to achieve the desired filtering effect. As depicted in FIGS. 3–4, signal and reference vias are often realized as thin cylinders formed within the substrate. Although not a requirement of the invention, each via may have the same cross sectional size and shape. Alternatively, as shown in FIG. 4, all of the vias need not be equally sized. In a practical embodiment, manufacturing limitations may place restrictions on the minimum sheet thickness of the substrate and, consequently, the minimum via length. Such manufacturing considerations may also affect the minimum diameter or cross sectional area of the vias and, consequently, the minimum pitch between vias.

Generally, the via region may be considered as an interconnect with a certain impedance. Decreasing the pitch between the signal via and the reference vias, increasing the via diameter, and increasing the number of reference vias are techniques for increasing the capacitance associated with the signal transmission and, therefore, reducing the impedance of the via region. If the impedance of the via region is adjusted to achieve less than a 50 Ohm characteristic impedance, the associated capacitance of the region and the inductance of the fanout region create an effective LC oscillation tank with a certain resonance frequency, which significantly affects the filter characteristic.

Fanout region 132 may also be specifically configured according to the desired filter response. For example, if additional capacitance is required, then the reference island around the signal via can be extended to cover a larger angle around the signal via and, in extreme cases, the signal via can be completely surrounded by the reference island. If additional inductance is required, then a larger cutout of the reference island around the signal via can be utilized. The specific layout of fanout region 132 determines, at least in part, the characteristics of the high frequency discontinuity introduced by the via transition. As described above, certain features of fanout region 132 can be adjusted to obtain an impedance mismatch rather than an optimized impedance match.

As stated previously, the capacitance or inductance of fanout region 132 can be adjusted by the geometry of the layout. The value of the corresponding capacitance or inductance together with the respective values associated with the vias and solder bumps determines the amplitude and frequency of the oscillations that affect the filter characteristic.

Figure 5:
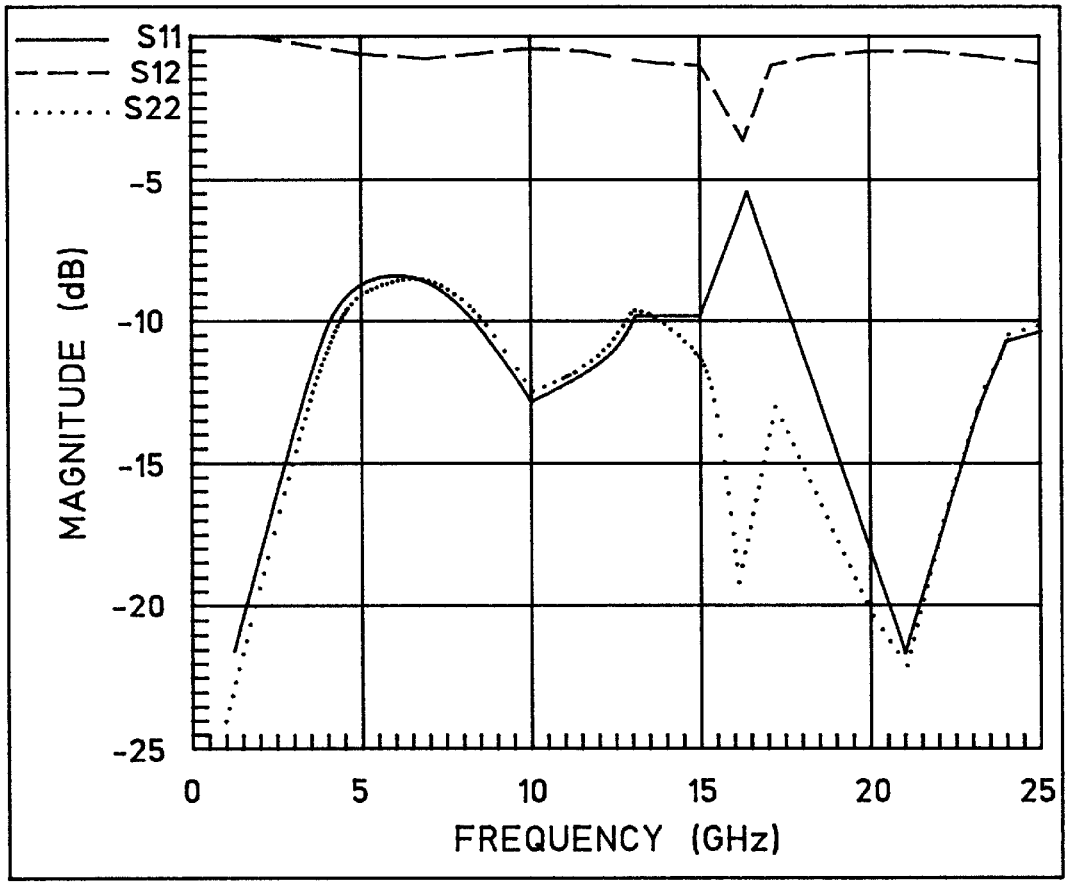
FIG. 5 is a graph of the S-parameters corresponding to an example bandpass filter arrangement according to the present invention.

FIG. 5 is a graph of the S-parameters corresponding to an example bandpass filter arrangement according to the present invention. The results shown in FIG. 5 represent the frequency response of an example layout for a sinusoidal clock having a frequency between 19 GHz and 23 GHz for.OC-768 data communications applications compliant with the SONET standard. In this example, each of the four reference vias are 0.008 inches in diameter, each of the two "near" reference vias (e.g., reference vias 118, 120) has a 0.020 inch pitch to the signal via, and each of the two "far" reference vias (e.g., reference vias 122, 124) has a 0.05 inch pitch to the signal via. The desired pass band for this example interconnect structure is 19–23 GHz. FIG. 5 depicts the return loss characteristics as a function of frequency at both ports (simulated return and insertion loss correspond to the two ports of the interconnect, where one port is on the die pad of the device chip 102 and the second port is on the motherboard at the end of the trace on the motherboard). As shown, a signal propagating through the interconnect structure will exhibit a return loss of less than −15 dB over the desired band of 19–23 GHz, while signals having frequencies outside of the band will be attenuated.

Figure 6:
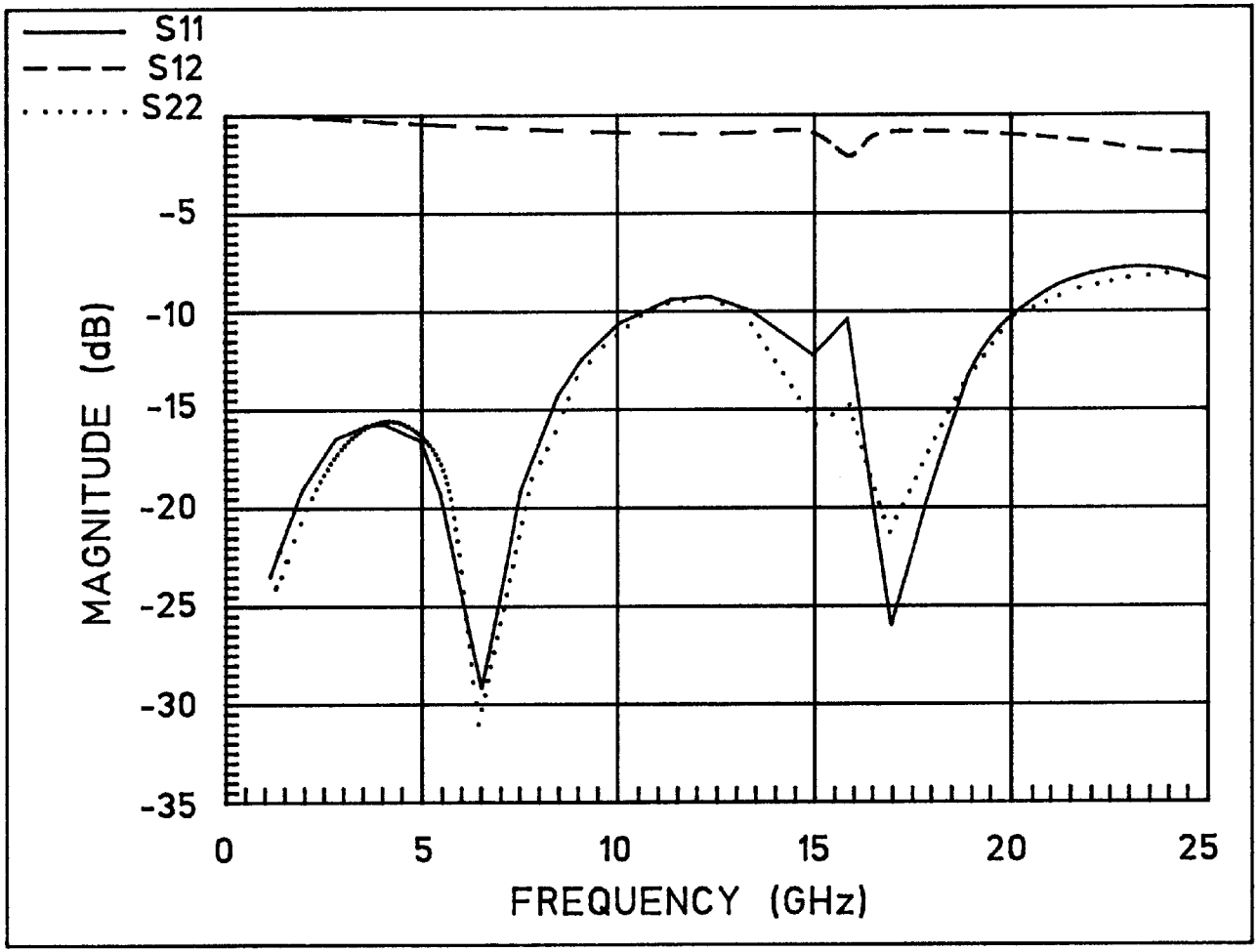
FIG. 6 is a graph of the S-parameters corresponding to an example lowpass filter arrangement according to the present invention.

FIG. 6 is a graph of the S-parameters corresponding to an example lowpass filter arrangement according to the present invention. FIG. 6 depicts the return and insertion loss characteristics as a function of frequency at both ports, where one port is on the die pad of the device chip 102 and the second port is on the motherboard at the end of the trace on the motherboard. Like the previous example, each of the four reference vias are 0.008 inches in diameter and each of the two "far" reference vias has a 0.05 inch pitch to the signal via. However, in contrast to the example represented by FIG. 5, each of the two "near" reference vias has a 0.035 inch pitch to the signal via. Although the difference in pitch is only 0.015 inch, the variation results in a lowpass filter response rather than a bandpass filter response.

The desired lowpass cutoff frequency for this filter characteristic is approximately 8 GHz, which corresponds to the fifth harmonic of the fundamental frequency of a 2.5 Gb/s signal. Such digital high speed signals having a data rate of 2.5 Gb/s are used in OC −48 applications. As shown, a signal propagating through the interconnect structure will exhibit a return loss of less than −15 dB if the frequency is less than approximately 8 GHz, while signals having higher frequencies will be attenuated.

Figure 7:
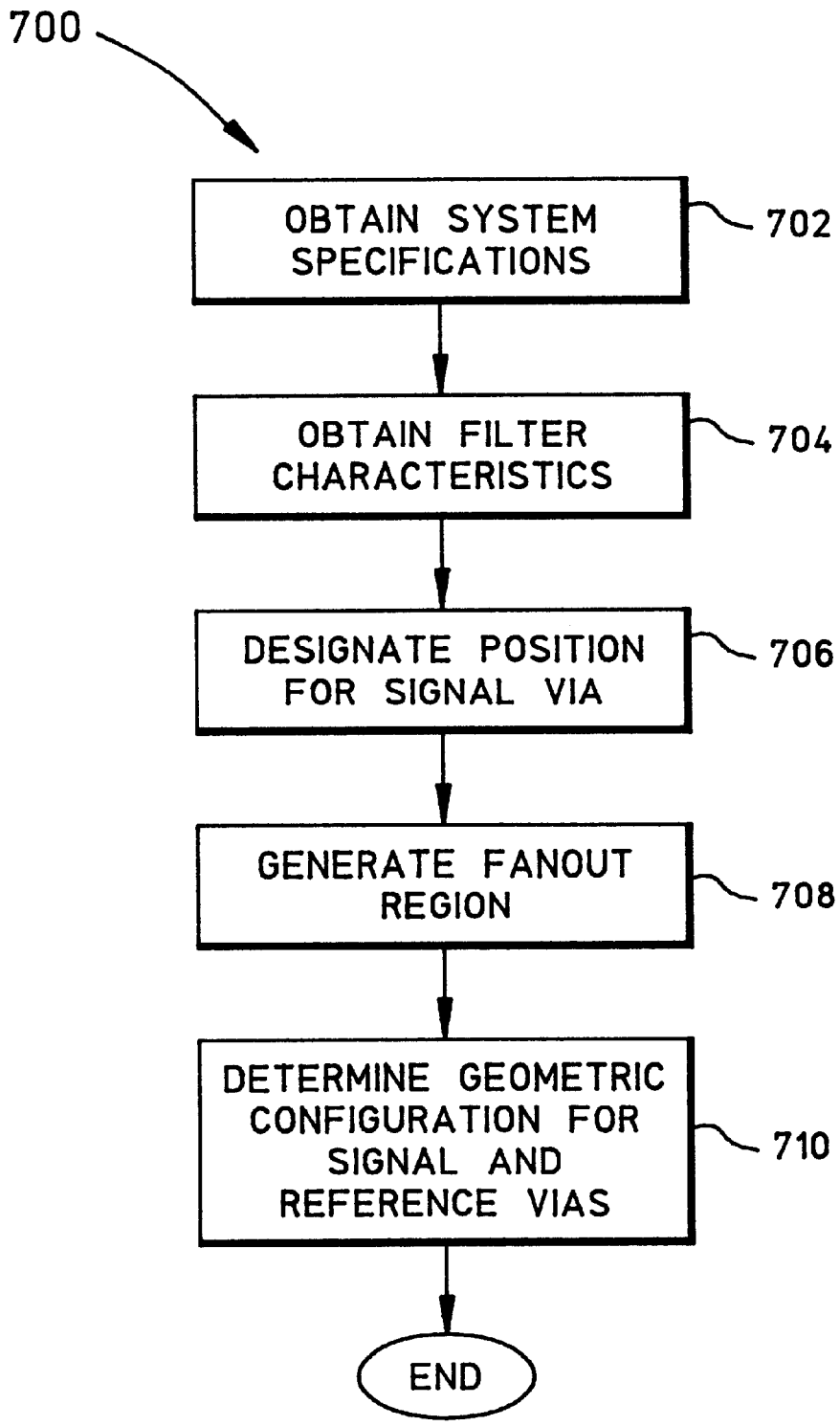
FIG. 7 is a flow chart depicting an interconnect fabrication process.

FIG. 7 is a flow chart of a fabrication process 700 for an interconnect structure according to the present invention. As described above, the filter characteristics of an interconnect structure may be determined, at least in part, by a number of different layout variables. The particular geometry of the resulting interconnect structure can be selected using a number of design or optimization techniques. In this regard, one or more of the tasks described below in connection with FIG. 7 may be performed by a simulation program, a CAD program, or the like.

Initially, a number of applicable system specifications are obtained (task 702); these system specifications provide an operating context for the interconnect design. For example, the system data rate, the application for the data signal, the system impedance, and other specifications may be obtained during task 702. Next, the desired filter characteristics are obtained (task 704). The filter characteristics may include the resonant or center frequency, the cutoff frequency or frequencies, the threshold return loss that defines the cutoff point(s), and the like. The filter characteristics obtained during task 704 may represent an ideal or optimized filter response (e.g., a lowpass filter response or a bandpass filter response) that serves as the practical design goal.

A location or position for the signal via is designated (task 706), and a fanout region corresponding to the signal via may be generated (task 708). Of course, these elements need not be determined in any particular order or in a discrete stepwise manner. Indeed, the via positioning, the layout of the fanout region, and other parameters associated with the configuration of the interconnect structure can be determined concurrently with the assistance of a suitable design program, e.g., package and interconnect design programs (such as the APD product from Cadence Design Systems, Inc.) and simulation programs (such as the HFSS product from Ansoft Corp.).

A geometric configuration for the signal and reference vias is determined during a task 710. The geometric configuration results in a realization of the desired filter response. For example, task 710 may begin with a desired resonant frequency of the interconnect structure; the resonant frequency may correspond to a filter cutoff frequency, a center frequency of a bandpass filter response, or the like. As an example, the resonance frequency can be obtained in connection including a single inductor having an inductance L and single capacitor having a capacitance C as follows: $f=\frac{1}{2\pi}\sqrt{LC}$. The size and the length of the vias may also affect the inductance and the capacitance as the impedance of the structure changes with respect to the 50 Ohm standard impedance (e.g., increasing the size of the via increases the capacitance). Eventually, task 710 attempts to emulate the specified filter response by adjusting the reference via pitch, the number of reference vias, the size of the reference vias, and/or by adjusting any of the parameters listed above.

Ultimately, the fabrication process 700 generates a suitable design for the interconnect structure, and that design is utilized during the manufacture of the multilayer substrate and to fabricate the interconnect structure within the multilayer substrate. Of course, depending upon the system specifications, the physical manufacturing limitations, and other practical considerations, it may not be possible to actually realize the desired filter response using only the interconnect structure. Nonetheless, the techniques described herein can be satisfactorily employed in connection with many practical filter designs.

The present invention has been described above with reference to a preferred embodiment. However, those skilled in the art having read this disclosure will recognize that changes and modifications may be made to the preferred embodiment without departing from the scope of the present invention. These and other changes or modifications are intended to be included within the scope of the present invention, as expressed in the following claims.

What is claimed is:

1. An electronic interconnect structure comprising:

signal via formed within a multilayer substrate having a first metal layer and a second metal layer;

at least one reference via formed within said multilayer substrate, said at least one reference via and said signal via being configured to propagate a signal from said first metal layer to said second metal layer, said at least one reference via and said signal via being further configured to provide a bandpass filter response for said signal.

2. An electronic interconnect structure according to claim 1, wherein said filter response is determined at least in part by spatial positioning of said at least one reference via relative to said signal via.

3. An electronic interconnect structure according to claim 2, wherein said filter response is determined at least in part by a pitch between said signal via and said at least one reference via.

4. An electronic interconnect structure according to claim 1, wherein said filter response is determined at least in part by the cross sectional area of said at least one reference via.

5. An electronic interconnect structure according to claim 1, wherein said filter response is determined at least in part by the cross sectional area of said signal via.

6. An electronic interconnect structure according to claim 1, wherein said filter response is determined at least in part by the length of said at least one reference via.

7. A method for fabricating an electronic interconnect structure comprising:

obtaining a bandpass filter characteristic for a signal propagating through a multilayer substrate having a first metal layer and a second metal layer, designating a position within said multilayer substrate for a signal via; and determining a geometric configuration for said signal via and for at least one reference via to provide said bandpass filter characteristic for said signal.

8. A method according to claim 7, wherein determining said geometric configuration comprises determining spatial positioning of said at least one reference via relative to said signal via.

9. A method according to claim 7, wherein determining said geometric configuration comprises determining a pitch between said signal via and said at least one reference via.

10. A method according to claim 7, wherein determining said geometric configuration comprises determining the cross sectional area of said at least one reference via.

11. A method according to claim 7, wherein determining said geometric configuration comprises determining the cross sectional area of said signal via.

12. A method according to claim 7, wherein determining said geometric configuration comprises determining a return loss characteristic for said signal propagating through said multilayer substrate.

13. A method according to claim 7, further comprising generating a fanout configuration for a conductive element corresponding to said at least one reference via.

14. A method according to claim 7, further comprising generating a fanout configuration for a conductive element corresponding to said signal via.

15. An electronic package comprising:

a multilayer substrate having a plurality of metal layers;

a conductive signal element formed on one of said plurality of metal layers;

a conductive reference element formed on one of said plurality of metal layers;

a signal via formed within said multilayer substrate and connected to said conductive signal element; and a reference via formed within said multilayer substrate and connected to said conductive reference element, said reference via and said signal via being configured to provide a bandpass filter characteristic for a signal propagating through said multilayer substrate.

16. An electronic package according to claim 15, wherein said filter characteristic is determined at least in part by spatial positioning of said reference via relative to said signal via.

17. An electronic package according to claim 16, wherein said filter characteristic is determined at least in part by a pitch between said signal via and said reference via.

18. An electronic package according to claim 15, wherein said filter characteristic is determined at least in part by the cross sectional area of said reference via.

19. An electronic package according to claim 15, wherein said filter characteristic is determined at least in part by the cross sectional area of said signal via.

20. An electronic package according to claim 15, wherein said filter characteristic is determined at least in part by the length of said at least one reference via.

21. An electronic package according to claim 15, further comprising a fanout region defined by said conductive signal element and by said conductive reference element.

22. An electronic package according to claim 21, wherein said filter characteristic is determined at least in part by said fanout region.

23. An electronic package according to claim 15, further comprising at least one additional reference via formed within said multilayer substrate, said reference via, said at least one additional reference via, and said signal via being configured to provide said filter characteristic.

24. An electronic package according to claim 23, wherein said filter characteristic is determined at least in part by the geometric configuration of said reference via and said at least one additional reference via, relative to said signal via.

25. An electronic package according to claim 15, wherein said filter characteristic is determined at least in part by a capacitance associated with said signal via and said reference via.

26. An electronic package according to claim 15, wherein said filter characteristic is determined at least in part by an inductance associated with said signal via and said reference via.

27. An electronic package according to claim 15, wherein said conductive signal element and said conductive reference element are both formed on the same one of said metal layers.

28. An electronic package according to claim 15, wherein said at least one reference via and said signal via are further configured to propagate said signal from a first one of said metal layers to a second one of said metal layers.

* * * * *